US005588362A

United States Patent [19]

Sugiyama et al.

[11] Patent Number: 5,588,362

[45] Date of Patent: Dec. 31, 1996

[54] CYLINDER THROW-ON AND THROW-OFF MECHANISM FOR PRINTING PRESS

[75] Inventors: Hiroyuki Sugiyama; Norio Hirose, both of Ibaragi; Teruyoshi Hamabuchi, Kanagawa; Hikoji Muto, Tokyo, all of Japan

[73] Assignee: Komori Corporation, Japan

[21] Appl. No.: 433,224

[22] Filed: May 2, 1995

[30] Foreign Application Priority Data

May 6, 1994 [JP] Japan ..... 6-116079

[51] Int. Cl.[6] ..... B41F 13/24

[52] U.S. Cl. ..... 101/218; 101/185; 101/247

[58] Field of Search ..... 101/217, 218, 101/247, 143, 144, 145, 182, 184, 185

[56] References Cited

U.S. PATENT DOCUMENTS 5,142,981 9/1992 Dettinger et al. ..... 101/218
5,445,076 8/1995 Sugiyama et al. ..... 101/218

FOREIGN PATENT DOCUMENTS 56-26249 3/1981 Japan .
134244 6/1988 Japan ..... 101/218

*Primary Examiner*—Ren Yan
*Attorney, Agent, or Firm*—Blakely Sokoloff Taylor & Zafman

[57] ABSTRACT

A cylinder throw-on and throw-off mechanism for a printing press having a plate cylinder and a printing cylinder, which are disposed with outer surfaces being separated from each other, and a blanket cylinder disposed therebetween includes a driving unit and a control unit. The driving unit has a motor serving as a driving source and moves the blanket cylinder between an impression-on position where the blanket cylinder is pressed against the plate cylinder and simultaneously pressed against the printing cylinder through a paper sheet and an impression throw-off position where the blanket cylinder is separated from the plate cylinder and the printing cylinder in accordance with a direction of rotation and the number of revolutions of the motor. The control unit sets an operation pattern of the motor, which is defined by the total number of revolutions of the motor and a number of revolutions of said motor on the basis of a printing condition, and drives and controls the motor in accordance with the set operation pattern.

9 Claims, 9 Drawing Sheets

CYLINDER THROW-ON AND THROW-OFF MECHANISM FOR PRINTING PRESS

BACKGROUND OF THE INVENTION

The present invention relates to a cylinder throw-on and throw-off mechanism for pressing/separating a blanket cylinder against/from printing cylinders such as a blanket cylinder and an impression cylinder and adjusting gaps with respect to the printing cylinders in various types of printing presses including an offset rotary press and an intaglio printing press.

A cylinder throw-on and throw-off mechanism of this type is disclosed in Japanese Utility Model Laid-Open No. 56-26249. In the cylinder throw-on and throw-off mechanism disclosed in this prior art, an eccentric bearing is pivoted using a motor as a driving source, thereby performing an impression-on/impression throw-off operation of a blanket cylinder axially supported by the eccentric bearing with respect to a plate cylinder and an impression cylinder. With this arrangement, the impression-on/impression throw-off operation is performed by driving a single eccentric bearing, resulting in a simple arrangement and a decrease in number of components.

In the above-described conventional cylinder throw-on and throw-off mechanism, however, a sheet thickness adjustment mechanism for adjusting a gap between the blanket cylinder and the impression cylinder in correspondence with the thickness of a paper sheet is not incorporated in the motor driving system. Instead, another eccentric bearing is manually pivoted. With this arrangement, the impression-on/impression throw-off operation cannot be performed in a manner interlocked with sheet thickness adjustment, and the sheet thickness adjustment operation is individually performed. Therefore, sheet thickness adjustment is troublesome and requires a long time, resulting in a complex arrangement.

Additionally, in the impression-on/impression throw-off operation, the phase and timing for pressing/separating the blanket cylinder against/from the impression or plate cylinder must be out of the printing range of both the cylinders, i.e., within a range where the gaps of the blanket cylinder and the impression or plate cylinder oppose each other, so as not to adversely affect the thickness of an ink coated on a plate. In the above-described conventional mechanism, since the impression-on/impression throw-off operation is not preformed while taking the phase between the cylinders into consideration, it is difficult to set the timing for the impression-of/impression throw-off operation. When the impression-on/impression throw-off operation is performed at an inappropriate timing, waste sheets are produced.

SUMMARY OF THE INVENTION

It is an object of the present invention to provide a cylinder throw-on and throw-off mechanism capable of performing sheet thickness adjustment in a short time with a simple arrangement.

It is another object of the present invention to provide a cylinder throw, on and throw-off mechanism capable of performing an impression-on/impression throw-off operation in association with (in consideration of) the phase (rotation phase) between the cylinders.

In order to achieve the above objects, according to the present invention, there is provided a cylinder throw-on and throw-off mechanism for a printing press having a plate cylinder and a printing cylinder, which are disposed with outer surfaces being separated from each other, and a blanket cylinder disposed therebetween, comprising driving means, having a motor serving as a driving source, for moving the blanket cylinder between an impression-on position where the blanket cylinder is pressed against the plate cylinder and simultaneously pressed against the printing cylinder through a paper sheet and impression throw-off position where the blanket cylinder is separated from the plate cylinder and the printing cylinder in accordance with a direction of rotation and a number of revolutions of the motor, and control means for setting an operation pattern of the motor, which is defined by a total number of revolutions of the motor and a number of revolutions of the motor on the basis of a printing condition, and driving and controlling the motor in accordance with the set operation pattern.

DESCRIPTION OF THE PREFERRED EMBODIMENTS

A cylinder throw-on and throw-off mechanism according to an embodiment of the present invention will be described below with reference to the accompanying drawings. FIGS. 1 to 7 show the first embodiment in which the cylinder throw-on and throw-off mechanism according to the present invention is applied to an offset rotary press.

Figure 1:
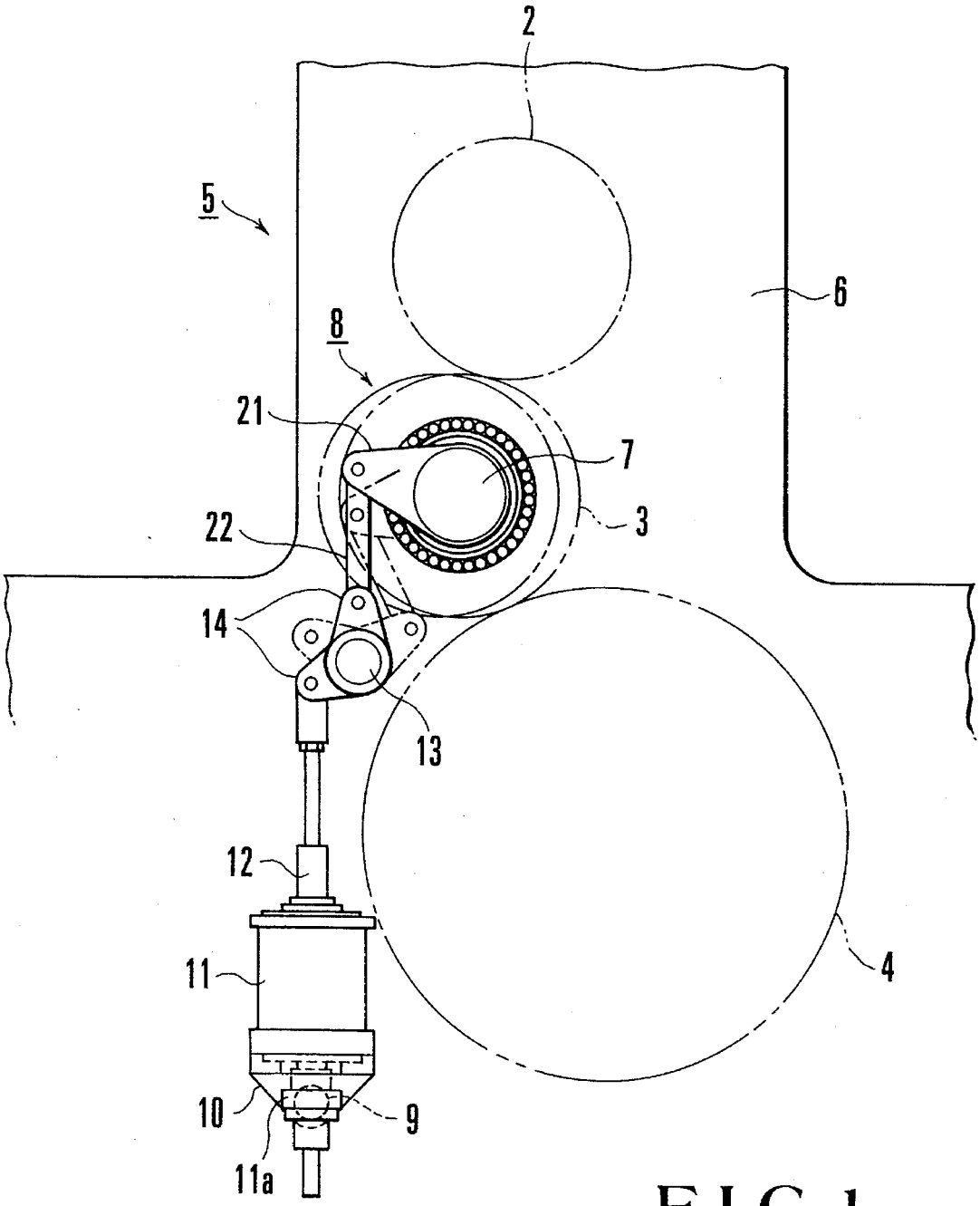
FIG. 1 is a side view showing a cylinder throw-on and throw-off mechanism according to the first embodiment of the present invention.

Referring to FIG. 1, the offset rotary press comprises a plate cylinder 2 mounted with a plate, an impression cylinder 4 serving as a printing cylinder arranged to be parallelly separated from the plate cylinder 2 by a predetermined interval, and a blanket cylinder 3 mounted with a blanket on its outer surface and brought into contact with the plate cylinder 2 and the impression cylinder 4 during a printing operation. Each shaft of the plate cylinder 2 and the impression cylinder 4 is rotatably and axially supported at its two ends by left and right frame is 6 provided to a printing unit 5, through a pair of bearings (not shown). A shaft 7 of the blanket cylinder 3 is rotatably and axially supported at its two ends by a pair of eccentric bearings (to be described later) fitted in the left and right frames 6.

Figure 2:
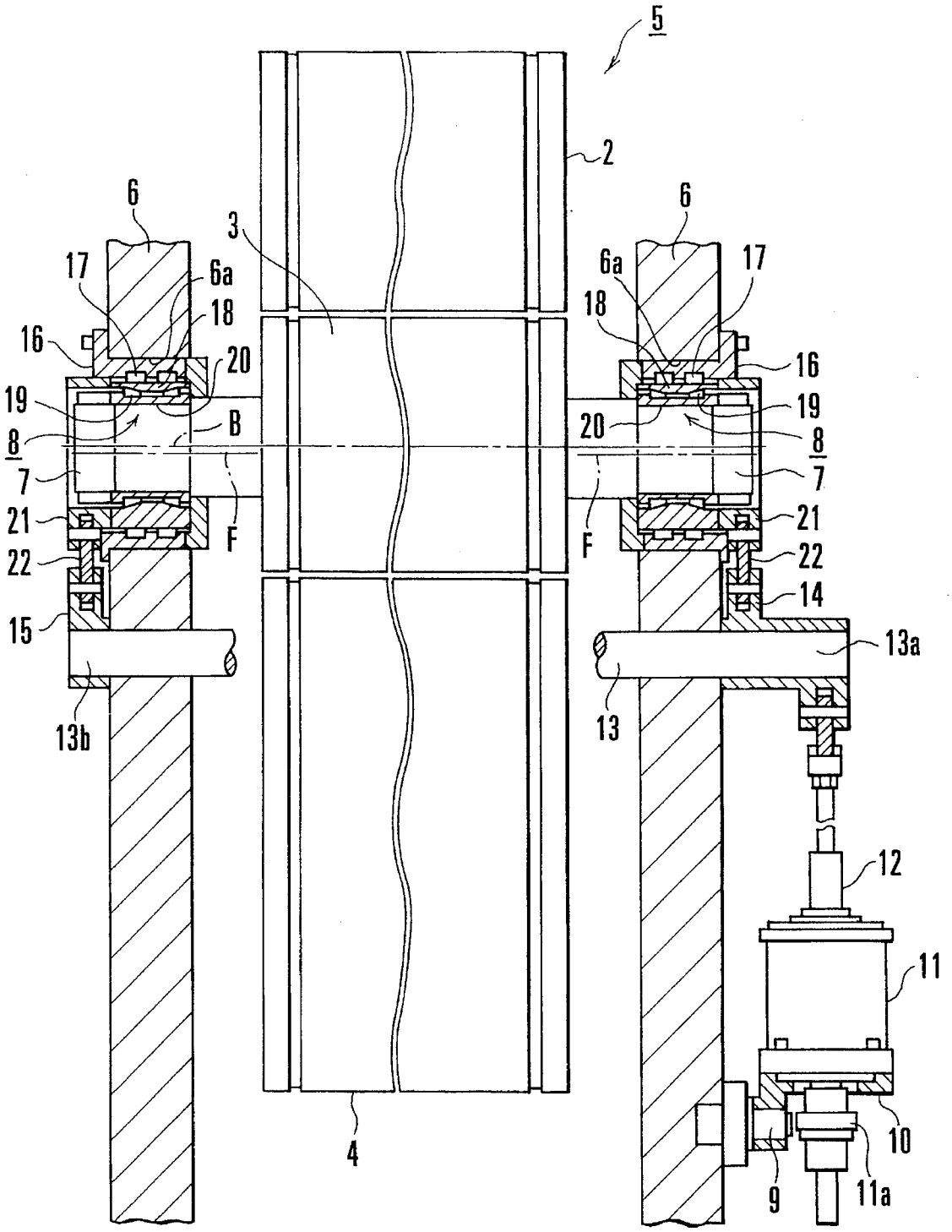
FIG. 2 is a partially cutaway exploded front view of the cylinder throw-on and throw-off mechanism in FIG. 1.

A bracket 10 is supported by a stud 9 projecting outward from one of the frames 6 to be close to the shaft of the impression cylinder 4. A stepping motor 11 serving as a driving unit is fixed to the bracket 10 while vertically standing a driving rod 12. When a nut 11*a* is rotated upon rotation of the stepping motor 11, the driving rod 12 having a screw portion threadably engaged with the nut 11*a* is moved. A lever 13 axially supported by the left and right frames 6 at its two end portions is arranged near the distal end of the driving rod 12. A coupling lever 14 having an L-shaped section, as shown in FIG. 2, is axially mounted on a projecting portion 13a of the lever shaft 13 projecting from one of the frames 6. A coupling lever 15 is axially mounted on another projecting portion 13*b* of the lever shaft 13.

The pair of left and right eccentric bearings 8 for axially supporting the shaft 7 of the blanket cylinder 3 are rotatably supported by housings 16 which are fitted in bearing holes 6*a* of the frames 6 and fixed with bolts through needle rollers 17, respectively. The eccentric bearing 8 is constituted by an outer ring 18 fitted in the housing 16 through the needle roller 17, and an inner ring 20 rotatably fitted in the outer ring 18 through tapered rollers 19. Bearing levers 21 on the left and right sides, which are fixed to the outer rings 18 of the eccentric bearings 8, are respectively coupled with the above-described coupling levers 14 and 15 through rods 22. When the driving rod 12 is moved upon rotation of the stepping motor 11, the eccentric bearings 8 on both the sides are pivoted through the coupling levers 14 and 14, the rods 22, and the bearing levers 21 while rolling the needle rollers 17.

In FIG. 2, reference symbol B denotes an axis of the inner surface of the inner ring 20 constituting the eccentric bearing 8, i.e., the axis of the blanket cylinder 3 in an impression-on state. Reference symbol F denotes an axis of the outer surface of the outer ring 18 of the eccentric bearing 8 (to be referred to as the axis of the eccentric bearing 8 hereinafter). The axes B and F are offset from each other by a predetermined size. A control unit 36 (to be described later) is connected to the cylinder throw-on and throw-off mechanism of this embodiment so as to operate each portion at a predetermined timing.

Figure 3:
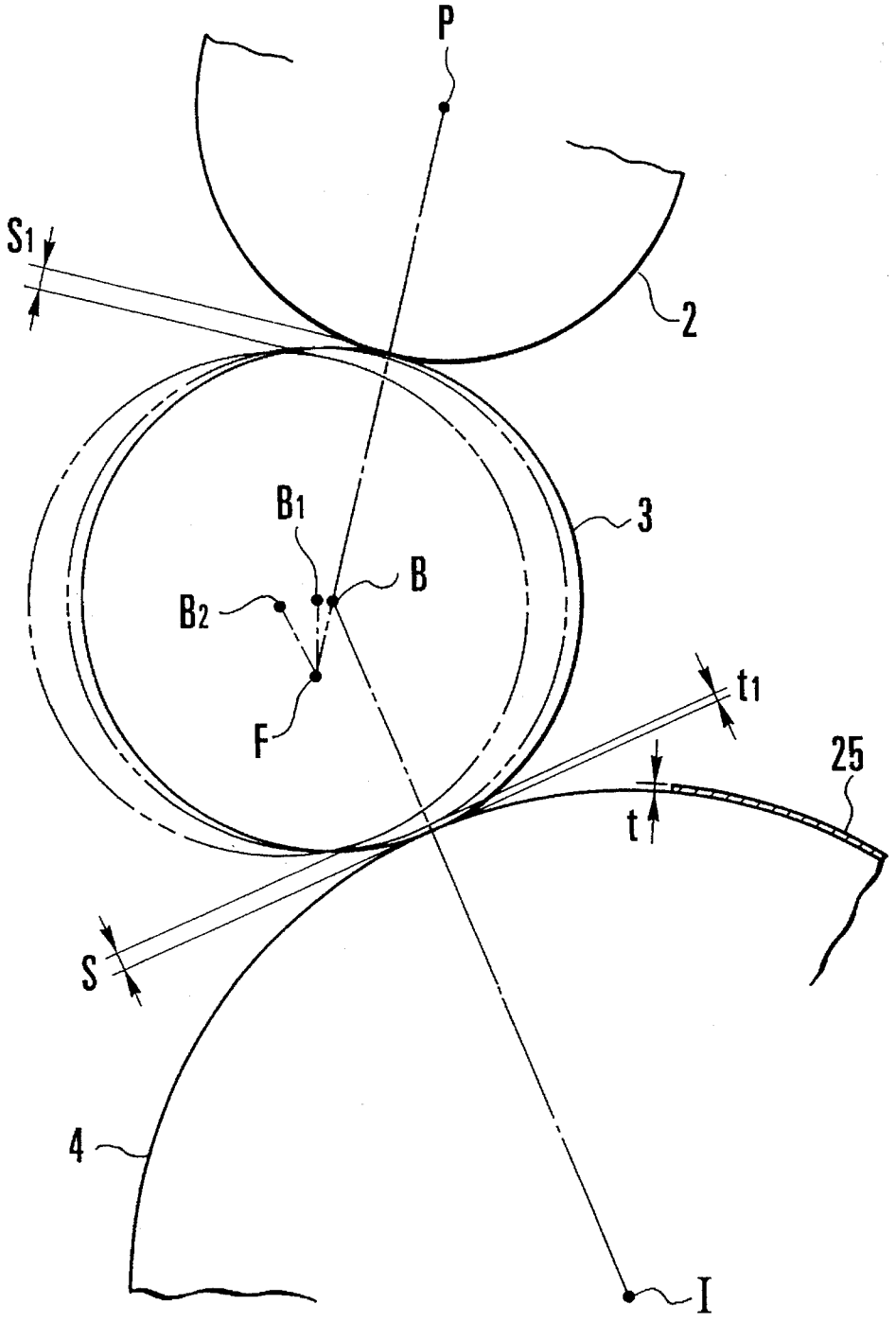
FIG. 3 is a schematic side view for explaining movement of the axis of a blanket cylinder by the pivotal movement of an eccentric bearing in the cylinder throw-on and throw-off mechanism in FIG. 1.
Figure 4:
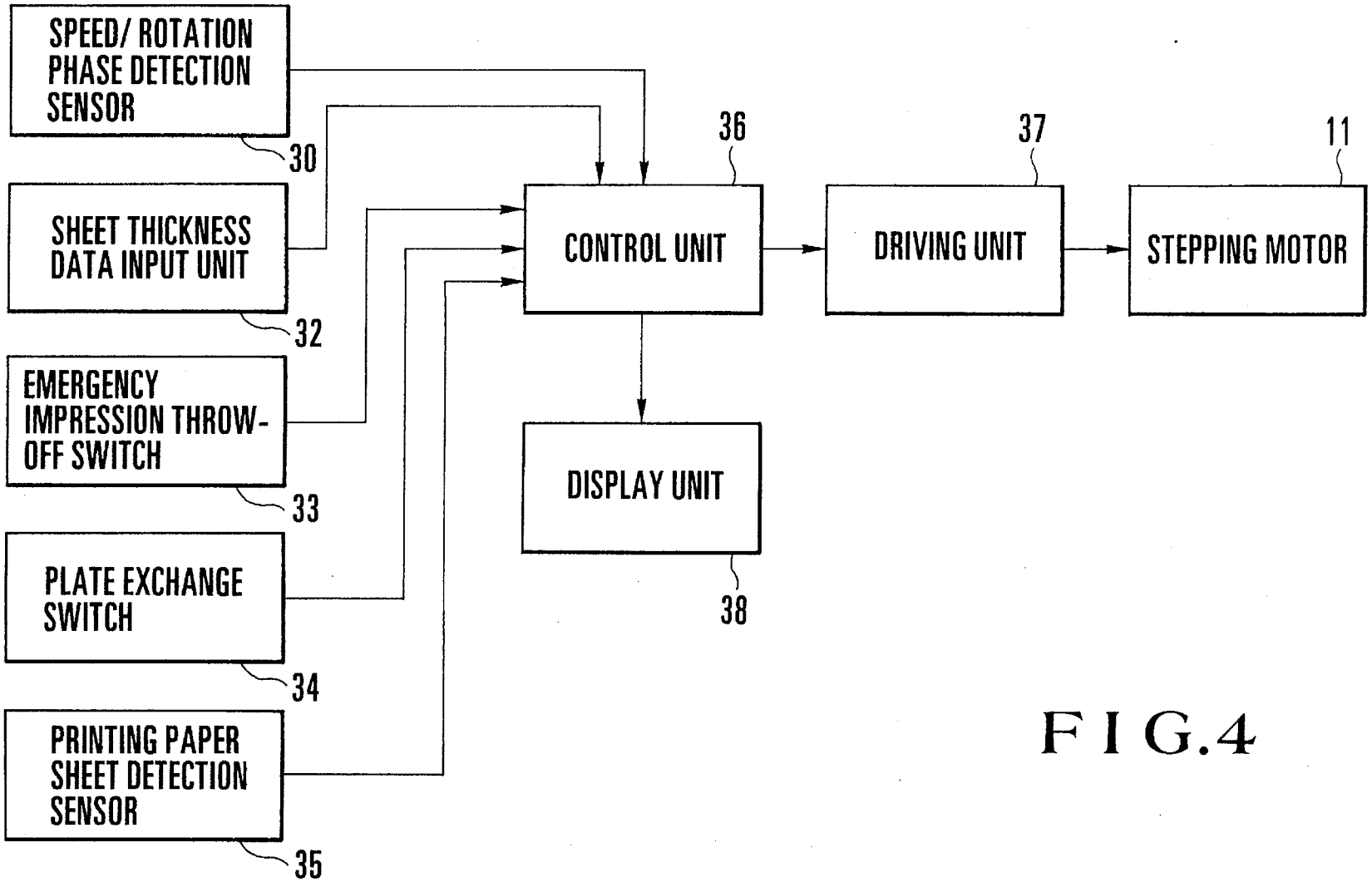
FIG. 4 is a block diagram of the cylinder throw-on and throw-off mechanism in FIG. 1.

Referring to FIG. 3 showing an impression-on state, an axis P of the plate cylinder 2 is separated from the axis B of the blanket cylinder 3 by an interaxial distance for applying an appropriate printing pressure to the contact portion between the outer surfaces of the two cylinders. Taking a thickness t of a printing paper sheet 25 into consideration, the axis B of the blanket cylinder 3 is separated from an axis I of the impression cylinder 4 by an interaxial distance for applying an appropriate printing pressure to the contact portion between the outer surfaces of the two cylinders.

When the impression throw-off operation is performed upon completion of the printing operation, the axis B of the blanket cylinder 3 pivots counterclockwise about the axis F of the eccentric bearing 8 to move to a position $B_2$ in FIG. 3. As a result, the interaxial distance between the axis P of the plate cylinder 2 and the axis $B_2$ of the blanket cylinder 3 increases to form a gap $S_1$ between the outer surfaces of the two cylinders. Similarly, the interaxial distance between the axis $B_2$ of the blanket cylinder 3 and the axis I of the impression cylinder 4 also increases to form a gap S between the outer surfaces, thereby setting an impression throw-off state. To restart the printing operation, the axis $B_2$ of the blanket cylinder 3 pivots clockwise about the axis F of the eccentric bearing 8 in FIG. 3 to move to the position of the axis B, thereby setting an impression-on state.

When the thickness of the paper sheet changes upon exchanging the printing paper sheet 25, the axis of the blanket cylinder 3 moves from the position B to a position $B_1$ such that an appropriate printing pressure is applied on the basis of sheet thickness data from a sheet thickness data input unit (to be described later). As a result, a gap $t_1$ shown in FIG. 3 is formed between the blanket cylinder 3 and the impression cylinder 4, thereby obtaining a printing pressure corresponding to the changed sheet thickness. Upon completion of the printing operation, the axis of the blanket cylinder 3 moves from the position $B_1$ to the above-described position $B_2$, thereby setting an impression throw-off state.

The stepping motor 11 is driven in accordance with an operation pattern set by the control unit 36. More specifically, referring to FIG. 4, reference numeral 30 denotes a speed/rotation phase detection sensor for detecting the operation speed and rotation phase of the printing press by using a known conventional sensor such as a rotary encoder for generating at one or more pulses for a predetermined phase every time the cylinder rotates by one revolution. Reference numeral 32 denotes a sheet thickness data input unit for inputting sheet thickness data by the operator. The sheet thickness data input unit 32 may be a unit for automatically measuring a sheet thickness instead of inputting data by the operator. Reference numeral 33 denotes an emergency impression throw-off switch used to perform the impression throw-off operation in case of abnormality of the printing press during the printing operation. The emergency impression throw-off switch may be an abnormality detection sensor for detecting the abnormality of the printing press and outputting an abnormality signal. Reference numeral 34 denotes a plate exchange switch for performing an operation of bringing the blanket cylinder 3 into contact with the plate cylinder 2 to bring a plate into tight contact with the outer surface of the plate cylinder in mounting the plate on the plate cylinder of the printing press.

Reference numeral 35 denotes a printing paper sheet detection sensor using a known conventional sensor, which is arranged on a printing paper sheet conveyance path between a feeder for supplying printing paper sheets and the printing unit. The printing paper sheet detection sensor 35 issues an impression-on command when the printing paper sheets supplied from the feeder are detected in an impression throw-off state, and issues an impression throw-off command when the printing paper sheets supplied from the feeder are not detected in an impression-on state. The control unit 36 determines the operation pattern of the stepping motor 11 in accordance with signals supplied from the speed/rotation phase detection sensor 30, the sheet thickness data input unit 32, the emergency impression throw-off switch 33, and the plate exchange switch 34 and outputs a drive control signal to a driving unit 37. The driving unit 37 outputs an operation signal, an operation speed signal, or a stop signal on the basis of the drive control signal output from the control unit 36, thereby driving the stepping motor 11. Reference numeral 38 denotes a unit for displaying a sheet thickness input by the sheet thickness data input unit 32. The operator confirms the thickness of sheets used in the current printing operation by the display unit 38.

The impression-on operation will be described below. Referring to FIGS. 1 and 2, when the stepping motor 11 rotates by the number of revolutions or steps, which is calculated and determined by the control unit 36, the driving rod 12 moves to pivotally move both the eccentric bearings 8 along a circular arc about the axis F of the eccentric bearings 8 through the coupling levers 14 and 15, the rods 22, and the bearing levers 21 while rolling the needle rollers 17. With this operation, the axis of the blanket cylinder 3 moves from the position $B_2$ to the position B in FIG. 3. The blanket cylinder 3 at the impression throw-off position is brought into contact with the plate cylinder 2 and subsequently moved to a position corresponding to the sheet thickness to set an impression-on state with respect to the impression cylinder 4.

Figure 5A:
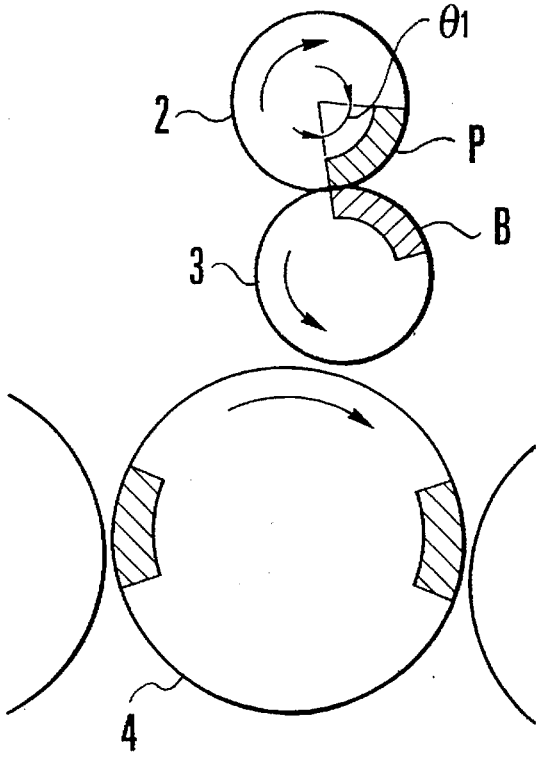
FIGS. 5A and 5B are schematic side views for explaining timings and positional (phase) relationships between cylinders in impression-on and impression throw-off operations of the cylinder throw-on and throw-off mechanism in FIG. 1.
Figure 5B:
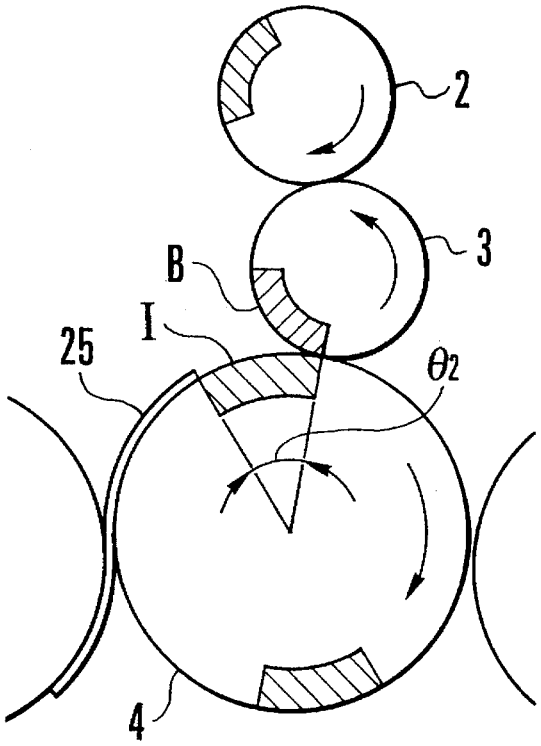

Timings and positional (phase) relationships between the cylinders in the impression-on operation and will be described below with reference to FIGS. 5A and 5B. The timing for bringing the blanket cylinder 3 into contact with the plate cylinder 2 must be out of the printing range of the two cylinders, i.e., within a range of an angle $\theta_1$ where a gap P of the plate cylinder 2 and a gap B of the blanket cylinder 3 oppose each other, as shown in FIG. 5A, so as not to adversely affect the thickness of an ink coated on the plate. Similarly, the timing for bringing the blanket cylinder 3 into contact with the impression cylinder 4 must be within a range of an angle $\theta_1$ where the gap B of the blanket cylinder 3 and a gap I of the impression cylinder 4 oppose each other, as shown in FIG. 5B.

After the paper sheet is supplied, the printing paper sheet detection sensor 35 detects the paper sheet, and the impression-on operation is performed immediately before the paper sheet passes between the blanket cylinder and the impression cylinder. An image transferred from the plate on the plate cylinder 2 to the blanket on the blanket cylinder 3 is transferred to the paper sheet 25 passing between the blanket cylinder 3 and the impression cylinder 4, thereby performing printing. Upon completion of the printing operation, the impression cylinder 4 is separated from the blanket cylinder 3 at the same timing as in the above-described impression-on operation, i.e., within the range of the angle $\theta_2$ where the gaps B and I oppose each other. Similarly, the stepping motor 11 is reversely rotated at a timing for separating the blanket cylinder 3 from the plate cylinder 2, i.e., within the range of the angle $\theta_1$ where the gaps P and B oppose each other. With this operation, the axis of the blanket cylinder 3 is pivotally moved from the position B to the position $B_2$, thereby performing an impression throw-off operation.

Figure 6:
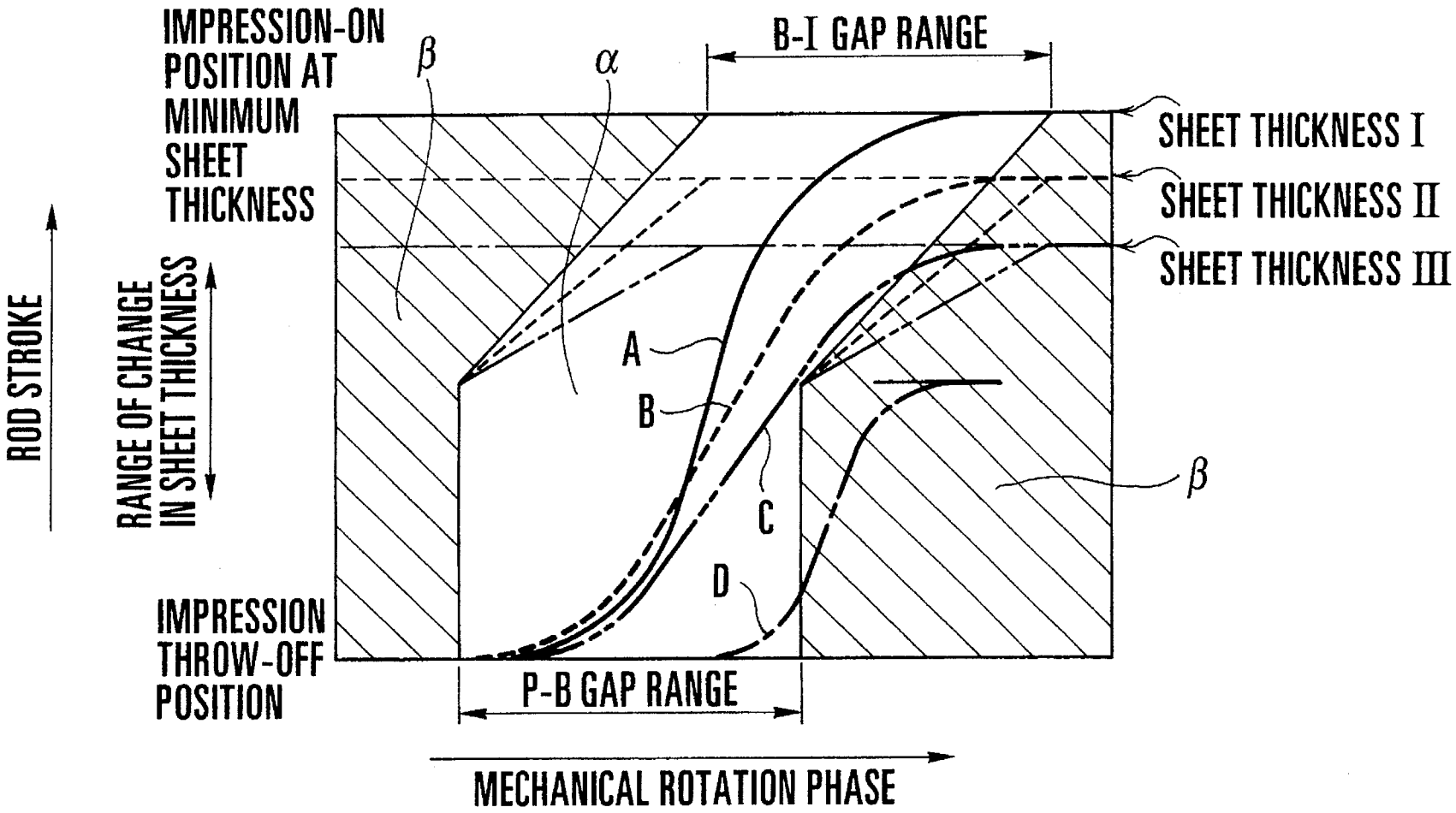
FIG. 6 is a view showing operation patterns so as to explain the operation patterns of a rod in the impression-on operation in the cylinder throw-on and throw-off mechanism in FIG. 1.
Figure 7:
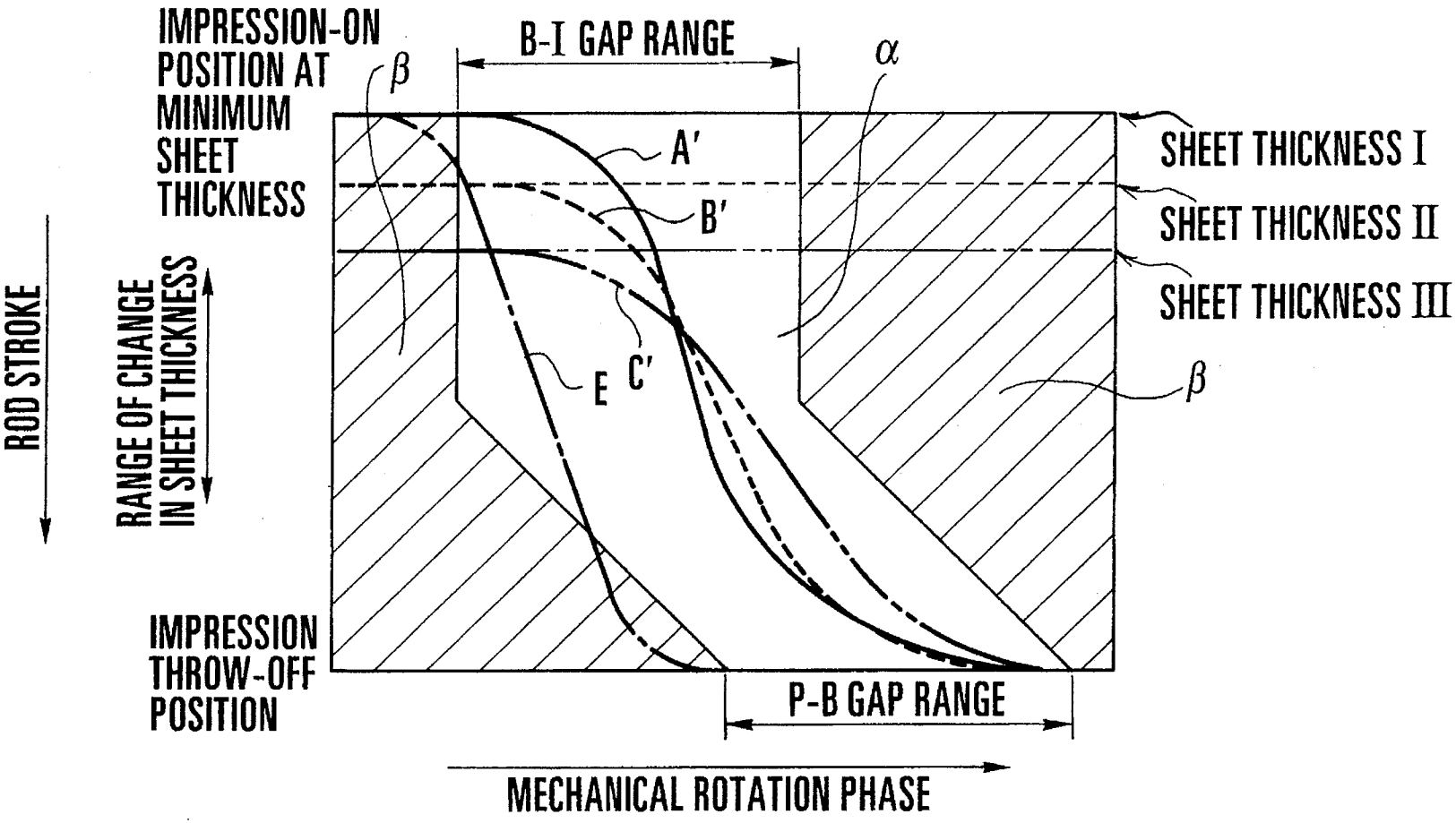
FIG. 7 is a view showing operation patterns so as to explain the operation patterns of the rod in the impression throw-off operation in the cylinder throw-on and throw-off mechanism in FIG. 1.

The operation patterns of the impression-on/impression throw-off operation will be described below with reference to FIGS. 6 and 7. Referring to FIGS. 6 and 7, the mechanical rotation phase of the printing press is plotted along the abscissa, and the stroke (reciprocal amount) of the driving rod 12 according to rotation of the stepping motor 11 is plotted along the ordinate. The lowermost point represents an impression throw-off position while the uppermost point represents an impression-on position at a minimum sheet thickness. A portion $\alpha$ indicated by a central blank portion represents mechanical rotation phases within a range allowing the impression-on/impression throw-off operation as the above-described timing for the impression-on/impression throw-off operation. The operation pattern of the driving rod 12 must be set within the portion $\alpha$.

The portion $\alpha$ changes depending on, e.g., the arrangement or diameters of the plate cylinder 2, the blanket cylinder 3, and the impression cylinder 4. It also changes depending on the sheet thickness. At a minimum sheet thickness I, the boundary is indicated by a solid line. At an intermediate sheet thickness II, the boundary is indicated by a broken line. At a maximum sheet thickness III, the boundary is indicated by a chain double-dashed line. A portion $\beta$ indicated by hatching represents a printing enable range excluding the gaps P, B., and I. The impression-on operation must be avoided in the portion $\beta$ because it is not preferable.

Curves A, B, and C in FIG. 6 represent operation patterns of the stepping motor 11 in the impression-on operation, which respectively correspond to the sheet thicknesses I, II, and III. A curve D represents an operation pattern for a plate exchanging operation Curves A', B', and C', in FIG. 7 represent operation patterns of the Stepping motor 11 in the impression throw-off operation, which respectively correspond to the sheet thicknesses I, II, and III. A curve E represents an operation pattern for an emergency impression throw-off operation.

The operation of the stepping motor 11 corresponding to each operation pattern will be described below. Prior to the operation of the printing press, sheet thickness data is input from the sheet thickness data input unit 32 to the control unit 36. The control unit 36 sets the total number of revolutions of the stepping motor 11, which corresponds to the operation stroke length of the driving rod 12, and the acceleration/deceleration rate of the stepping motor 11, i.e., the inclination of the curve A.

Data as a basis for an operation pattern representing the relationship between the mechanical rotation phase and the operation stroke of the driving rod 12, e.g., an operation pattern represented by the curve A in FIG. 6 at the sheet thickness I is set.

After the preparation, the printing press is operated, and printing paper sheets are supplied from the feeder. A Signal is output from the printing paper sheet detection sensor 35 to the control unit 36. The speed/rotation phase detection sensor 30 outputs a speed signal and a phase signal. At this time, the control unit 36 calculates the speed of the stepping motor 11 on the basis of the speed signal and data serving as a basis for an operation pattern and outputs an impression-on operation signal to the stepping motor 11 through the driving unit 37 at a predetermined timing on the basis of the phase signal. With this operation, the stepping motor 11 rotates in accordance with the calculated and predetermined speed and the predetermined total number of revolutions, i.e, the operation pattern A, thereby performing the impression-on operation of the blanket cylinder 3 to a predetermined position.

Upon completion of the printing operation, supply of printing paper sheets from the feeder is stopped. The printing paper sheet detection sensor 35 detects the absence of printing paper sheets to output a signal to the control unit 36, and the speed/rotation phase sensor 30 outputs a speed signal and a phase signal. At this time, the control unit 36 outputs an impression throw-off operation signal to the stepping motor 11 through the driving unit 37 at a predetermined timing on the basis of this phase signal. With this operation, the stepping motor 11 rotates in a direction reverse to that in the impression-on operation at a speed calculated by the control unit 36 on the basis of the speed signal and data serving as a basis of an operation pattern, e.g., in accordance with the operation pattern A', thereby performing the impression throw-off operation.

If thin paper sheets are replaced with thick paper sheets, new sheet thickness data, e.g., the sheet thickness II is input to the sheet thickness data input unit 32. The control unit 36 sets the total number of revolutions of the stepping motor 11 and a new operation pattern, e.g., the operation pattern B defined by the relationship between the mechanical rotation phase and the operation stroke. In accordance with the operation pattern B, an impression-on operation corresponding to the sheet thickness II is performed.

When the plate is to be exchanged before a printing operation is newly started, the plate exchange switch 34 is operated to output a plate exchange signal to the control unit 36. At this time, an impression-on operation signal according to the operation pattern D shown in FIG. 6 is output to the driving unit 37 regardless of the phase of the printing press. The stepping motor 11 rotates on the basis of the total number of revolutions, which is calculated by the control unit 36 in advance, to bring the blanket cylinder 3 into contact with the plate cylinder 2. With this operation, the plate gripped by a gripper-side plate lockup device is brought into tight contact with the outer surface of the plate cylinder 2, thereby improving the plate mounting precision.

If some abnormality occurs during the printing operation, and the printing press must be stopped, the emergency impression throw-off switch 33 is operated to output an emergency impression throw-off signal to the control unit 36. At this time, an impression throw-off signal according to the operation pattern E shown in FIG. 7 is output to the driving unit 37 regardless of the phase of the printing press. The stepping motor 11 reversely rotates to perform the impression throw-off operation of the blanket cylinder 3. If an abnormality detection sensor for detecting abnormality of the printing press is arranged, an emergency impression throw-off signal is automatically output to the control unit 36 upon detection of abnormality by the abnormality detection sensor.

As described above, the operation patterns of the stepping motor 11 for performing the impression-on/impression throw-off operation by the control unit 36 include not only the operations patterns A to C and A' to C' based on the sheet thickness data according to input signals from the speed/rotation phase detection sensor 30 and the sheet thickness data input unit 32 but also the operation patterns D and E according to the operations of the plate exchange switch 34 and the emergency impression throw-off switch 33.

Figure 8:
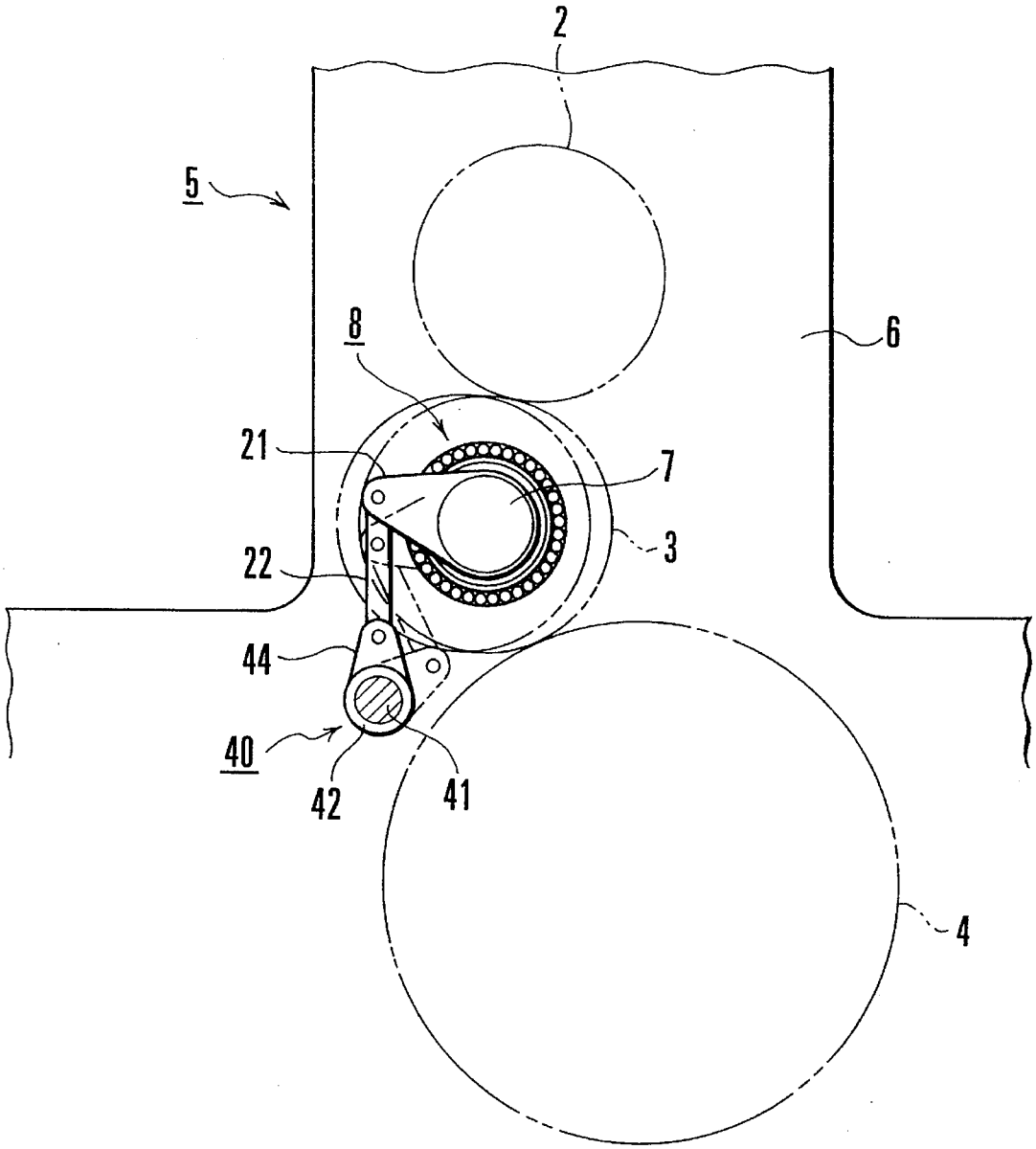
FIG. 8 is a side view showing a cylinder throw-on and throw-off mechanism according to the second embodiment of the present invention.
Figure 9:
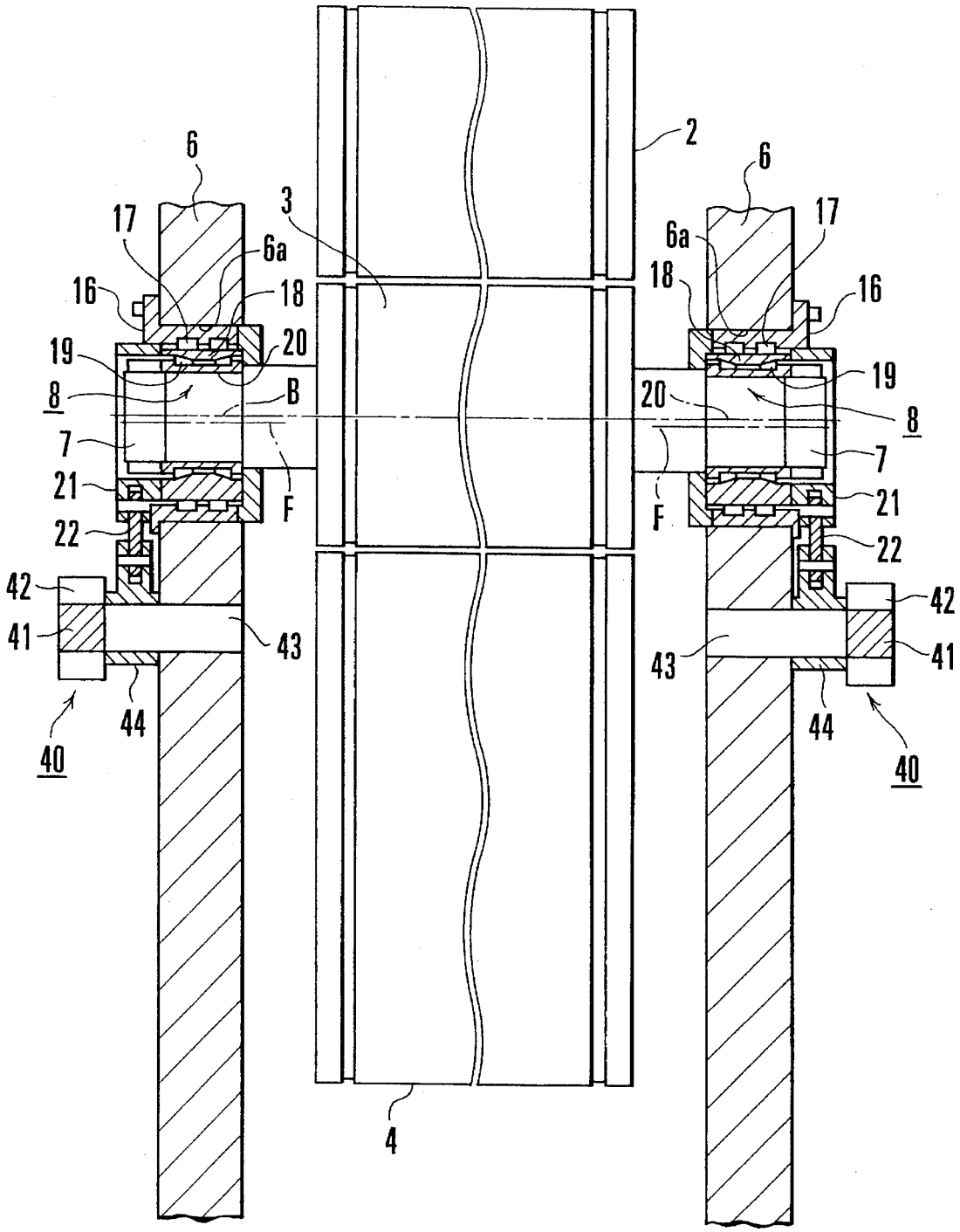
FIG. 9 is a partially cutaway exploded front view of the cylinder throw-on and throw-off mechanism in FIG. 8.

FIGS. 8 and 9 show the second embodiment of the present invention. The same reference numerals as in the first embodiment denote the same parts in the second embodiment, and a detailed description thereof will be omitted. The second embodiment is characterized in that an outer rotor type direct driving system is used in place of the stepping motor 11 serving as a driving source in the first embodiment. More specifically, an outer rotor type direct drive motor 40 has a stator 41 at its center, which is fixed to a frame 6. A rotating outer rotor 42 is arranged around the stator 41. In the motor 40, the stator 41 is fixed to a pin 43 standing from the frame 6 and supported by the frame 6, and a lever 44 pivotally supported by the pin 43 and having its free end portion connected to a rod 22 through a pin is fixed to the outer rotor 42.

With the above arrangement, when the motor 40 is operated by a control unit 36 through a driving unit 37 on the basis of a predetermined operation pattern, the outer rotor 42 pivots to swing the lever 44. Upon swing of the lever 44, an eccentric bearing 8 pivots through the rod 22 and a bearing lever 21 to move a blanket cylinder 3, thereby performing an impression-on/impression throw-off operation of the blanket cylinder 3. The rod 22 is directly swung by rotating the outer rotor 42 of the motor 40. Therefore, the number of components can be decreased, and the mechanism can be simplified, thereby achieving size reduction of the mechanism.

Although the curve A is set as an operation pattern, the operation pattern is not necessarily limited to the inclination of the curve A. To further soften the shock in the impression-on operation, a curve for further decelerating the final speed of the stepping motor 11 may be set as far as the curve does not extend from the portion α in FIGS. 6 and 7.

In addition, a speed sensor and a rotation phase sensor may be individually arranged in place of the speed/rotation phase detection sensor 30. In this case, a tachogenerator or the like may be used as a means for detecting the printing speed, and a proximity sensor or the like may be used as a means for detecting the rotation phase. Various changes and modifications can be made.

The operation pattern of the stepping motor 11 is set in accordance with the total number of revolutions of the stepping motor 11 and a relationship between the mechanical rotation phase and the number of revolutions of the stepping motor 11. However, the operation pattern may be set only in accordance with the total number of revolutions of the stepping motor 11 without using the relationship between the mechanical rotation angle and the number of revolutions of the stepping motor 11. In this case, acceleration/deceleration of the stepping motor 11 is not controlled. The operation pattern is indicated by a straight line in FIGS. 6 and 7. When acceleration/deceleration is not controlled, the acceleration/deceleration characteristics of the stepping motor 11 itself, e.g., the deceleration characteristics by inertial rotation after driving is stopped may be used.

As has been described above, according to the present invention, there is provided a cylinder throw mechanism having a plate cylinder and a printing cylinder, which are disposed with outer surfaces being separated from each other, and a blanket cylinder disposed therebetween, and a driving unit for moving the blanket cylinder between an impression-on position where the blanket cylinder is pressed against the plate cylinder and simultaneously pressed against the plate cylinder and the printing cylinder through a paper sheet and an impression throw-off position where the blanket cylinder is separated from the plate cylinder and the printing cylinder, wherein a motor is used as the driving source of the driving unit, and a control unit for freely setting the operation pattern of the motor. With the control unit, various types of operation patterns of the impression-on/impression throw-off operation can be automatically executed without requiring an operator. Therefore, the operation is facilitated, thereby decreasing the operation time and labor.

According to the present invention, since rotation of the motor is converted into a linear movement by a rod, the printing cylinder can be precisely moved.

According to the present invention, since an outer rotor type direct drive motor is used, the number of components can be decreased, and the mechanism can be simplified, thereby achieving size reduction of the mechanism.

According to the present invention, since the moving amount of the plate cylinder is controlled in accordance with the number of revolutions of a stepping motor, the moving amount can be accurately controlled, and the control system can be simplified.

According to the present invention, the control unit can change the operation pattern of the motor on the basis of sheets thickness data, and the impression-on/impression throw-off operation can be automatically executed in accordance with various sheet thicknesses without requiring an operator. For this reason, the operation is facilitated, thereby decreasing the operation time.

According to the present invention, operation patterns such as an impression-on/impression throw-off operation according to a rotation phase and an emergency impression-on/impression throw-off operation can be selected. For this reason, the mechanism can cope with various types of operation patterns, thereby improving convenience in use.

What is claimed is:

1. A cylinder throw-on and throw-off mechanism for a printing press having a plate cylinder and a printing cylinder, which are disposed with outer surfaces being separated from each other, and a blanket cylinder disposed therebetween, comprising:

driving means, having a motor serving as a driving source, for moving said blanket cylinder between an impression-on position where said blanket cylinder is pressed against said plate cylinder and simultaneously pressed against said printing cylinder through a paper sheet and an impression throw-off position where said blanket cylinder is separated from said plate cylinder and said printing cylinder in accordance with a direction of rotation and a number of revolutions of said motor;

control means for setting an operation pattern of said motor, which is defined by a total number of revolutions of said motor and a relationship between a mechanical rotation phase and said total number of revolutions of said motor, and driving and controlling said motor in accordance with said set operation pattern, wherein said control means determines an operation timing and said operation pattern such that a gap angle of said blanket cylinder is included within ranges of a gap angle of said plate cylinder and a gap angle of said printing cylinder;

sheet thickness data generation means for generating sheet thickness data of a printing paper sheet, and wherein said control means sets the operation pattern of said motor on the basis of the sheet thickness data; and phase detection means for detecting a rotation phase of said printing press, and wherein said control means calculates an operation timing of an impression-on/impression throw-off operation of said blanket cylinder in accordance with a phase signal output from said phase detection means and drives and control said motor in accordance with said operation pattern.

2. A mechanism according to claim 1, further comprising speed detection means for detecting an operation speed of said printing press, and wherein said control means sets the operation pattern of said motor on the basis of speed data as the printing condition output from said speed detection means.

3. A mechanism according to claim 1, further comprising abnormality signal generation means for generating an abnormality signal representing an abnormality of said printing press during a printing operation, and wherein, when the abnormality signal is generated from said abnormality signal generation means, said control means immediately drives said motor in accordance with the predetermined operation pattern to start an impression throw-off operation of said blanket cylinder.

4. A mechanism according to claim 1, further comprising plate exchange signal generation means for generating a plate exchange signal representing exchange of a plate for said printing press, and wherein, when the plate exchange signal is generated from said plate exchange signal generation means, said control means immediately drives said motor in accordance with the predetermined operation pattern to start an impression-on operation of said blanket cylinder.

5. A mechanism according to claim 1, wherein said driving means comprises a rod member for performing a linear movement in accordance with rotation of said motor, a conversion mechanism for converting the linear movement of said rod member into a pivotal movement, and a swing mechanism for swinging said blanket cylinder between the impression-on position and the impression throw-off position in accordance with the pivotal movement of said conversion mechanism, and said control means controls the number of revolutions of said motor in correspondence with a swing amount of said blanket cylinder.

6. A mechanism according to claim 1, wherein said motor is constituted by a direct drive motor having an outer rotor, said driving means comprises a swing mechanism for swinging said blanket cylinder between the impression-on position and the impression throw-off position in accordance with a pivotal movement of said motor, and a coupling mechanism for coupling said outer rotor of said direct drive motor with said swing mechanism, and said control means controls the number of revolutions of said motor in correspondence with a swing amount of said blanket cylinder.

7. A mechanism according to claim 1, wherein said motor is constituted by a stepping motor, and said control means controls a number of steps of said stepping motor to execute the set operation pattern.

8. A mechanism according to claim 1, wherein said control means performs the motor driving control in accordance with the operation pattern that the motor revolution is accelerated/decelerated at the impression-on position and at the impression throw-off position and said revolution maintains the predetermined speed between said impression-on position and said impression throw-off position.

9. A cylinder throw-on and throw-off mechanism for a printing press, having a plate cylinder and a printing cylinder, which are disposed with outer surfaces being separated from each other, and a blanket cylinder disposed therebetween, comprising:

driving means, having a motor serving as a driving source, for moving said blanket cylinder between an impression-on position where said blanket cylinder is pressed against said plate cylinder and simultaneously pressed against said printing cylinder through a paper sheet and an impression throw-off position where said blanket cylinder is separated from said plate cylinder and said printing cylinder in accordance with a direction of rotation and a number of revolutions of said motor;

sheet thickness data generation means for generating sheet thickness data of a printing paper sheet;

speed detection means for detecting an operation speed of said printing press;

phase detection means for detecting a rotation phase of said printing press; and control means for setting an operation pattern of said motor, which is defined by a total number of revolutions of said motor and a number of revolutions of said motor on the basis of the sheet thickness data and speed data respectively output from said sheet thickness data generation means and said speed detection means, calculating an operation timing of an impression-on/impression throw-off operation of said blanket cylinder in accordance with a phase signal output from said phase detection means, and driving and controlling said motor in accordance with the operation pattern set at the calculated operation timing, wherein said control means determines an operation timing and said operation pattern such that a gap angle of said blanket cylinder is included within ranges of a gap angle of said plate cylinder and a gap angle of said printing cylinder, further wherein said control means performs the motor driving control in accordance with ssaid operation pattern that the motor revolution is accelerated/decelerated at the impression-on position and at the impression throw-off position and said revolution maintains the predetermined speed between said impression-on position and said impression throw-off position.

* * * * *

UNITED STATES PATENT AND TRADEMARK OFFICE

CERTIFICATE OF CORRECTION

PATENT NO. : 5,588,362

DATED : December 31, 1996

INVENTOR(S) : Sugiyama et al.

It is certified that error appears in the above-identified patent and that said Letters Patent is hereby corrected as shown below:

In column 1 at line 61, please delete " throw, on " and insert -- throw-on --.

In column 4 at line 7, please delete " thickness " and insert -- thickness t --.

In column 6 at lines 12 and 32, please delete " S " and insert -- s --.

Signed and Sealed this

Seventh Day of October, 1997

*Attest:*

Bruce Lehman

BRUCE LEHMAN

*Attesting Officer*

*Commissioner of Patents and Trademarks*